United States Patent [19]

Hacker

[11] Patent Number: 5,065,661

[45] Date of Patent: Nov. 19, 1991

[54] HAND HELD ELECTRONIC KEYBOARD INSTRUMENT

[76] Inventor: Robert G. Hacker, 1024 N. Parkview, Baton Rouge, La. 70815

[21] Appl. No.: 441,899

[22] Filed: Nov. 27, 1989

[51] Int. Cl.[5] ..... G10H 1/32; G10H 5/00; G10H 3/00

[52] U.S. Cl. ..... 84/719; 84/600; 84/468; 84/670; 84/743

[58] Field of Search ..... 84/718–720, 84/743–745, 723–737, 741, DIG. 15, 467–469, 327, 329, 421, 453, 644, 670

[56] References Cited

U.S. PATENT DOCUMENTS

| | | | |
|---|---|---|---|
| 1,941,373 | 12/1933 | Weidemann | 84/403 |
| 3,084,584 | 4/1963 | Iorio . | |
| 3,278,671 | 10/1966 | Berwin | 84/1.04 |
| 3,541,912 | 11/1970 | Radke | 84/715 |
| 3,610,802 | 10/1971 | Berwin | 84/1.07 |
| 4,078,464 | 3/1978 | Sugiyama | 84/1.01 |
| 4,091,702 | 5/1978 | Murakami | 84/1.16 |
| 4,126,070 | 11/1978 | Hill | 84/718 |
| 4,226,154 | 10/1980 | Easler | 84/719 X |
| 4,352,310 | 10/1982 | Orlandoni | 84/718 |
| 4,380,947 | 4/1983 | Nishimoto | 84/176 |
| 4,462,294 | 7/1984 | Kazimer | 84/721 X |
| 4,653,375 | 3/1987 | Honda | 84/719 X |
| 4,909,117 | 3/1990 | Reiling et al. | 84/738 |

*Primary Examiner*—William M. Shoop, Jr.
*Assistant Examiner*—J. Donels
*Attorney, Agent, or Firm*—Robert C. Tucker; William David Kiesel

[57] ABSTRACT

A keyboard instrument is provided, comprising a keyboard housing having a top and a bottom; a handle attached to and extending from the bottom of the keyboard housing; a keyboard having a plurality of keys operatively attached to the top of the housing; a plurality of keyboard controls, mounted on the keyboard housing; a sound component housing; at least one speaker mounted in the sound component housing; a synthesizer, mounted within the sound component housing; and keyboard, sound component and communications circuitry. The instrument may include a volume expression control mounted in the handle, enabling user to control volume expression while maintaining the instrument in a horizontally oriented plane.

13 Claims, 3 Drawing Sheets

HAND HELD ELECTRONIC KEYBOARD INSTRUMENT

BACKGROUND OF THE INVENTION

1. FIELD OF THE INVENTION

This invention relates generally to keyboard-type musical instruments and, more particularly, to portable keyboard instruments which are hand-held.

2. PRIOR ART

Great advances have been made in the field of keyboard instruments due to the development of sophisticated synthesizers. Integrated circuits have enabled keyboard designers to produce a complex variety of sounds and instrument emulation from small, compact keyboard units. The typical unit comprises a housing containing synthesizer circuitry, an amplifier, a speaker unit, a power source and, of course, a keyboard with associated voice and general controls. When used professionally, such units are connected to external power and external sound systems. Such combination units are also heavy and are difficult to use in a hand-held performance. Thus, performing units have been designed with neck straps, and are played with the plane of the keyboard in an unnatural, vertically oriented position. Prior art attempts at separating the keyboard unit from the electronic components thereof maintain the vertically oriented position and neck strap support (see U.S. Pat. No. 4,126,070).

Further, despite advanced miniaturization electronics and synthesizer development, there are no fully portable performance-grade keyboard/synthesizer units available. The availability of such units would enable young musicians to develop their talents in keyboard bands, with each musician having independent control over each instrument.

A keyboard band is nothing new. The first keyboard bands were most likely accordion bands. The accordion is a bulky instrument and its mobility is limited because of the necessity of either music being memorized or having to use music stands. With the great improvements in quality electronic and digital sound reproduction, keyboards as well as other instruments can imitate natural acoustic instruments such as strings, woodwinds, brass and percussion. The easiest to play of all instruments is the keyboard. The technique of playing or pressing a key is easier and the nature of music notation (written music) is easily applied to the keyboard. Therefore, with the improved quality of sound and the ease of playing a keyboard, the director, teacher and student are involved with only one basic technique. This makes possible a wider range of participation in music by persons six years of age to the senior adult.

Several keyboards played through the same sound system make it hard for the beginner to distinguish the tones he or she is playing, from those played by others. In prior art keyboards which have self-contained speakers, the direction of the sound is upward. It is therefore hard for a director and player to balance the sounds and difficult for an audience to hear. If the keyboard is tilted so that the self contained speaker is facing outward, the keyboard is more difficult to play and again music must be memorized or the musician is kept immobile by a music stand.

Any kind of cord, whether to an electrical outlet, stationary amplifier or voice box would inhibit mobility and would cause enormous problems for larger ensembles, such as orchestras or marching bands. Present keyboards (except accordions where the bellows are used to increase or decrease volume for expression) use an attached "expression" or volume pedal. Again, this prohibits mobility. The word "portable" with reference to keyboard presently means that it can be moved easily and in no way indicates complete mobility while performing.

SUMMARY OF THE INVENTION

Therefore, it is an object of this invention to provide a lightweight keyboard instrument which is easily supported with one hand while playing the unit with the other.

It is another object of this invention to provide such a keyboard instrument which may be supported or played in a generally horizontal plane.

It is yet another object of this invention to provide a keyboard instrument which comprises separate lightweight keyboard and sound component units, both of which are fully portable and can be carried by the musician during performance.

It is a further object of this invention to provide such a keyboard instrument which allows the musician to operate selected instrument controls with the hand which is supporting the instrument.

It is another object of this invention to provide such a keyboard instrument which is battery-powered, but has the performance characteristics of professional instruments.

It is still a further object of this invention to accomplish the objects stated above in varying combinations.

Accordingly, a keyboard instrument is provided, comprising a keyboard housing having a top and a bottom; a handle attached to and extending from the bottom of the keyboard housing; a keyboard having a plurality of keys operatively attached to the top of the housing; a plurality of keyboard controls, mounted on the keyboard housing; a sound component housing; at least one speaker mounted in the sound component housing; a synthesizer, mounted within the sound component housing; and keyboard, sound component and communications circuitry. The instrument may include a volume expression control mounted in the handle, enabling the user to control volume expression while maintaining the instrument in a horizontally oriented plane.

As can be seen, the heavy components of the system are mounted in the sound component housing, which can be stationary or supported by a shoulder strap. The system is lightweight, mobile and playable in a horizontal plane.

DETAILED DESCRIPTION OF PREFERRED EMBODIMENTS OF THE INVENTION

Figure 1:
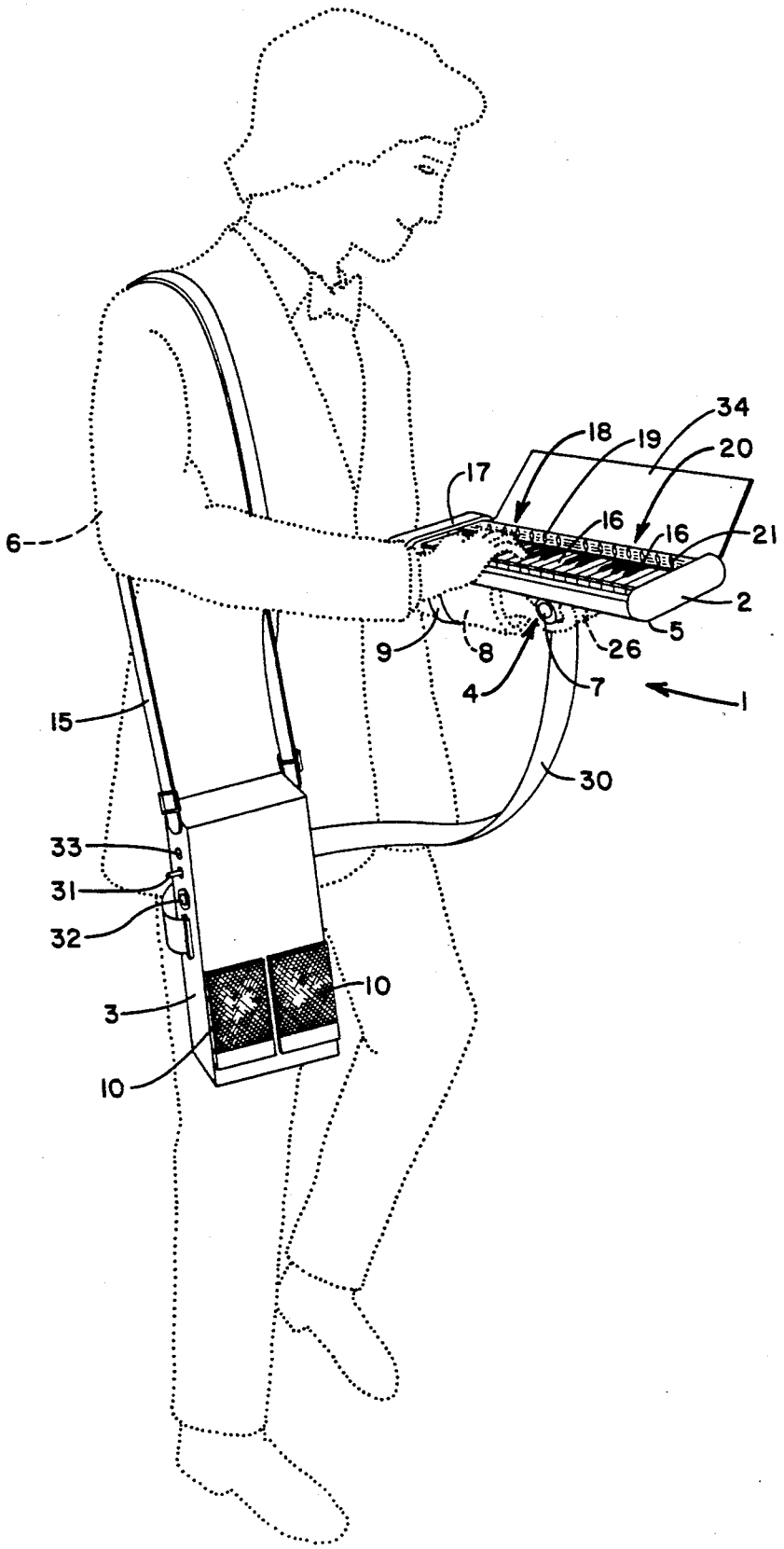
FIG. 1 is a perspective view of an embodiment of the invention in use.

As shown in FIG. 1, the invention 1 generally comprises a keyboard housing 2 and a sound component housing 3. Handle means 4 is attached to the bottom 5 of keyboard housing 2, and allows the musician 6 to support keyboard housing 2 in a generally horizontal plane.

Handle means 4 may take various forms according to the desired orientation and support of the keyboard housing 2. In the embodiment shown, handle means 4 includes a curved support handle 7. As shown, support handle 7 may be positioned near one end of keyboard housing 2. Additional support is gained from the musician's arm 8, as well as the optional arm strap 9. Thus, the musician can move the keyboard housing 2 about freely during performance while maintaining firm support. During such movement, the instrument 1 is easily maintained in a generally horizontal plane orientation.

Sound component housing 3 preferably contains all of the necessary heavier components of the invention. Inside sound component housing 3 are at least one speaker 10, amplification means 11, synthesizer means 12, and preferably a power supply 13. Obviously, it is necessary to tie the components of the instrument 1 together with electronic circuitry. However, this is preferably accomplished to the greatest extent possible within the sound component housing 3, rather than the keyboard housing 2, in order to reduce the weight of keyboard housing 2 and the components attached thereto. Strap 15 enables sound component housing 3 to be supported by the musician's shoulder, as shown.

Of course, the primary components on keyboard housing 2 are the keys 16. A plurality of conventionally sequenced black and white keys 16 are operatively attached to the top 17 of housing 2 by means known in the art. Such means would likely include spring-loaded key switches (not shown). An example of operative connections for keys 16 can be seen in U.S. Pat. No. 4,126,070 (FIGS. 3 and 4), which utilizes optical interrupters to initiate response to key depression. Another example can be seen in U.S. Pat. No. 3,610,802 (FIGS. 8 and 10), which utilizes contact between electrical components to initiate key response.

A plurality of keyboard controls 18 are also operatively attached to housing 2. Modern keyboard instruments have numerous voice controls 19, enabling the musician 7 to emulate various instruments. It is preferable that voice controls be located on the top 17 of housing 2. Additional keyboard controls 18 may be provided on housing 2, such as general or effect controls 20 including rhythm controls 21, volume expression control 22, vibrato switch 23, sustain switch 24, portamento switch 25, and other controls known in the art such as parameter change, mode, voice style select and rhythm controls. The number and type of keyboard controls 18 utilized will vary according to the desired performance characteristics of the instrument 1.

Figure 2:
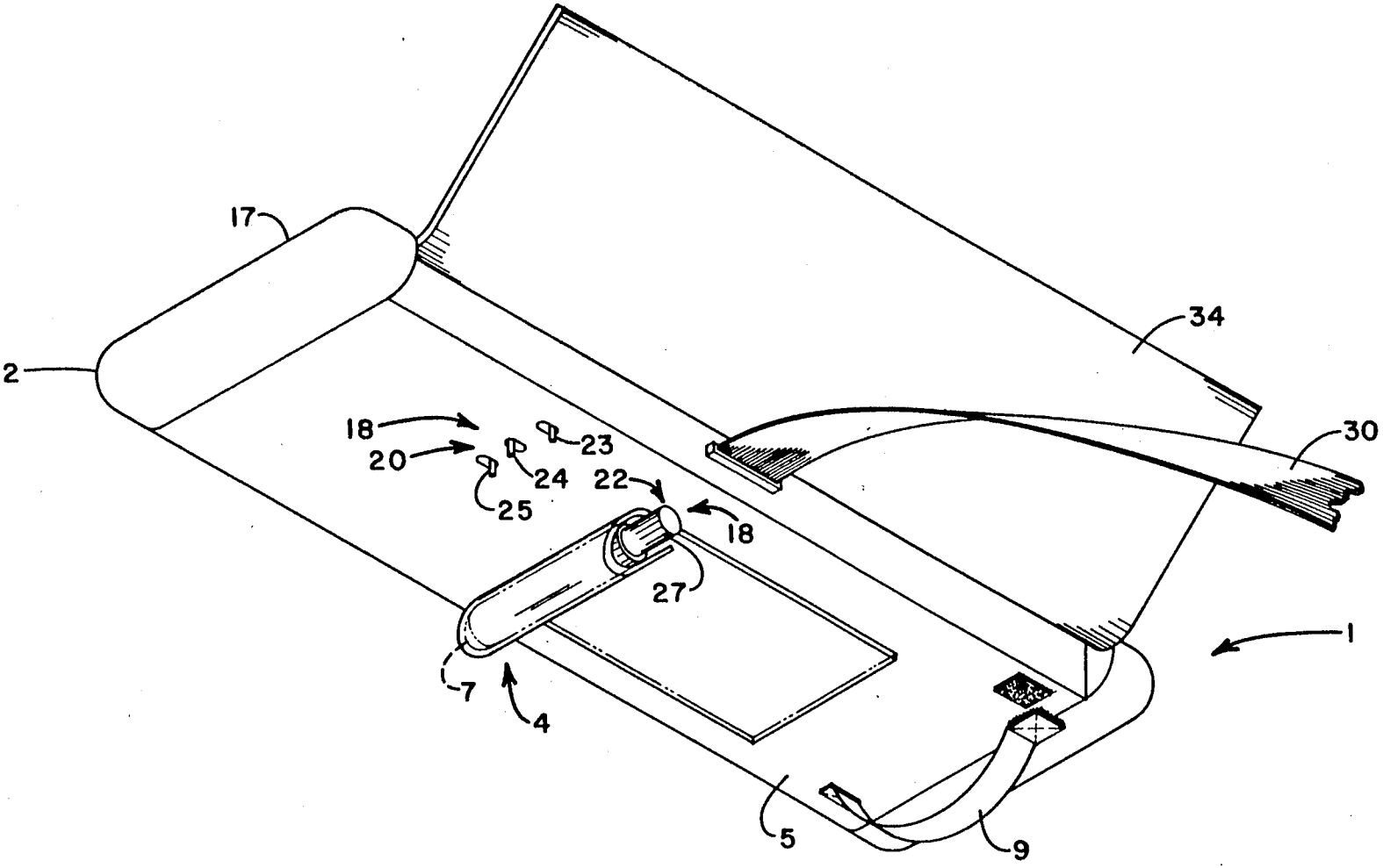
FIG. 2 is a perspective view of the bottom of the keyboard housing of the invention.

Preferably, certain keyboard controls 18 are mounted on bottom 5 and/or on support handle 7, within easy reach of the fingers of the musician's hand 26 which grips handle 7, as shown in FIG. 2. In the embodiment shown, volume expression control 22, vibrato switch 23, sustain switch 24 and portamento switch 25 are so mounted. Volume expression control 22 is shown as a spring-loaded, outwardly biased plunger 27 mounted on handle 7 such that volume is easily controlled by the thumb of musician's hand 26, which in turn controls volume expression during performance. Of course, many other embodiments of volume expression control 22 will occur to those skilled in the art. Many instruments have volume or master volume controls. The volume expression control 22 is a separate control that allows the musician to easily move from loud to soft within the limits of the master volume control 31, shown in the Figures on the sound component housing 3. Thus, musician 6 can control effects with the support hand 26 while supporting the keyboard housing 2 in a horizontal orientation, as shown.

Figure 3:
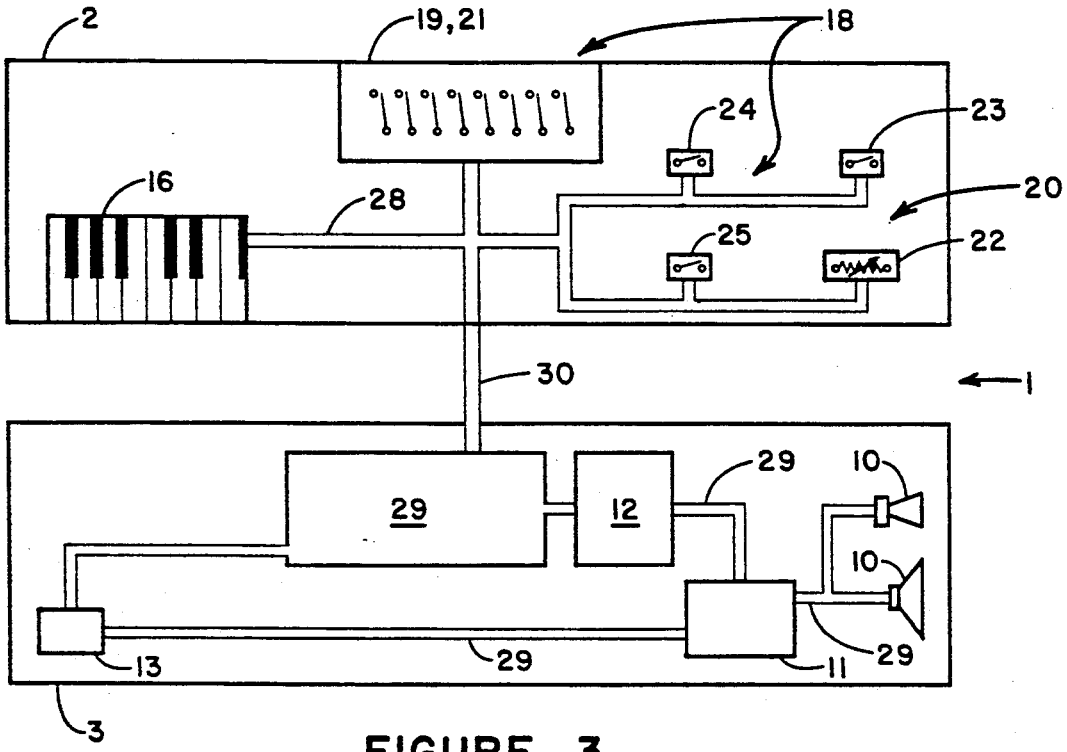
FIG. 3 schematic diagram of the circuitry of an embodiment of the invention.

The electronic components of the instrument 1 are shown schematically in FIG. 3. As stated above, the major electronic components are located in sound component housing 3. All electronic components of the instrument 1 are conventional integrated circuit components as used in present day electronic keyboard instruments. As shown, keys 16 and keyboard controls 18 are connected together by keyboard circuitry 28, which gathers the data produced at keys 16 and controls 18 and transmits it to the sound component circuitry 29 in sound component housing 3 via communications circuitry 30. While communications circuitry 30 is shown in the form of a wiring harness, or umbilical cord, any means known in the art may be utilized including wireless communication circuitry. Sound component circuitry 29 connects communications circuitry 30, power supply 13, synthesizer means 12, amplification means 11 and speaker(s) 10. While only one speaker 10 is required for operation, it may be preferred to use two or more speakers 10 for greater sound quality.

As stated above, keyboard circuitry 28, sound component circuitry 29, communications circuitry 30, synthesizer means 12, power supply 13 and amplification means 11 all may be conventionally constructed. U.S. Pat. No. 4,126,070, invented by Jeremy R. Hill, in FIGS. 6–12, discloses detailed schematic diagrams of typical electronic components which could be used in the instrument 1. The Hill patent utilizes a keyboard multiplexer and a switch multiplexer (analogous to keyboard circuitry 28), an umbilical cord (analogous to communications circuitry 30), and synthesizer control circuits (analogous to sound component circuitry 29 and synthesizer means 12). Amplification means 11 may take the form of any state of the art amplifier. Power supply 13 is preferably a battery (preferably rechargeable). Of course, other components known in the art may be used to comprise the electronic components of the invention 1. It is important, however, to locate the heavier components in sound component housing 3 to maximize portability.

Other features may be added to the system without decreasing the mobility of the user. As shown in FIG. 1, master volume control 31 may be connected to sound component housing 3 for flexibility, as well as a microphone input jack 32. A power switch 33 may also be conveniently located on sound component housing 3. Master volume control 31, jack 32 and switch 33 are easily connectable to sound component circuitry 29. The horizontal orientation of keyboard housing 2 during use allows music rack 34 may be mounted on keyboard housing 2 as shown in FIGS. 1 and 2. Preferably, music rack 34 is pivotally mounted so as to cover and protect keys 16 when the instrument 1 is not in use.

As can be seen, a keyboard instrument is provided which allows the user to operate the keyboard conventionally in a horizontal plane with great mobility. When used with sound component housing 3, the instrument 1 is totally portable, enabling groups of musicians to combine their efforts with great versatility. Other embodiments of the invention 1 will occur to those skilled in the art, and are intended to be within the scope and spirit of the following claims.

I claim:

1. A keyboard instrument, comprising:

a. a keyboard housing having a top and a bottom, said keyboard housing being of a shape and size such that said housing may be fully supportable by one hand of a user of said instrument;

b. a handle means, attached to and extending from said bottom of said housing, for supporting said housing in a generally horizontally-oriented plane when said handle means is gripped;

c. a keyboard having a plurality of keys operatively attached to said top of said housing;

d. a plurality of keyboard controls, mounted on said keyboard housing, said keyboard controls including a volume control mounted on said handle means so as to be accessible by the hand of the user of said instrument which is gripping said handle means, said volume control including an outwardly biased plunger accessible by the thumb of the user's hand which is gripping said handle means;

e. a sound component housing;

at least one speaker, mounted within said sound component housing;

g. a synthesizer means, for producing and controlling tones, mounted within said sound component housing;

h. an amplification means, for amplifying tones produced by said synthesizer means, mounted within said sound component housing;

i. keyboard circuitry, mounted within said keyboard housing;

j. sound component circuitry, mounted within said sound component housing;

k. communications circuitry, connecting said keyboard circuitry to said sound component circuitry; and l. a power supply; and wherein said keyboard circuitry is operatively connected to said keys, said keyboard controls and said communications circuitry, and said sound component circuitry is operatively connected to said synthesizer means, said amplification mean, said speaker, said power supply and said communications circuitry.

2. A keyboard instrument according to claim 1, further comprising:

m. a means for securing said keyboard housing to the arm of the user of said instrument which is supporting said instrument.

3. A keyboard instrument according to claim 2, wherein said means for securing said keyboard housing comprises a strap connected to said housing and spaced from said handle means.

4. A keyboard instrument according to claim 1, further comprising a music rack, connectable to said keyboard housing.

5. A keyboard instrument according to claim 1, wherein said keyboard controls include selected said keyboard controls mounted on said bottom of said keyboard housing and accessible by the hand of the user of said instrument which is gripping said handle means.

6. A keyboard instrument according to claim 1, wherein said power supply comprises a battery pack mounted within said sound component housing.

7. A keyboard instrument according to claim 1, further comprising:

n. a means for supporting said sound component housing from the body of the user thereof, connected to said sound component housing.

8. A keyboard instrument according to claim 7, wherein said means for supporting said sound component housing comprises a strap.

9. A keyboard instrument comprising:

a. a keyboard housing having a top and a bottom, said keyboard housing being of a shape and size such that said housing may be fully supportable by one hand of a user of said instrument;

b. a handle means, attached to and extending from said bottom of said housing, for supporting said housing in a generally horizontally-oriented plane when said handle means is gripped;

c. a keyboard having a plurality of keys operatively attached to said top of said housing;

d. a plurality of keyboard controls, mounted on said keyboard housing, said keyboard controls including a volume control mounted on said handle means so as to be accessible by the hand of the user of said instrument which is gripping said handle means, said volume control including an outwardly biased plunger accessible by the thumb of the user's hand which is gripping said handle means;

e. keyboard circuitry, mounted within said keyboard housing; and f. communications circuitry, operatively connected to said keyboard circuitry.

10. A keyboard instrument according to claim 9, further comprising:

m. a means for securing said keyboard housing to the arm of the user of said instrument which is supporting said instrument.

11. A keyboard instrument according to claim 10, wherein said means for securing said keyboard housing comprises a strap connected to said housing and spaced from said handle means.

12. A keyboard instrument according to claim 9, further comprising a music rack, connectable to said keyboard housing.

13. A keyboard instrument according to claim 9, wherein said keyboard controls include selected from said keyboard controls mounted on said bottom of said keyboard housing and accessible by the handle of the user of said instrument which is gripping said handle means.

* * * * *